United States Patent [19]

Short

[11] 4,050,163

[45] Sept. 27, 1977

[54] PROCESS AND APPARATUS FOR DRYING GRAIN IN SITU

[76] Inventor: Clifton Stanley Short, P.O. Box 105, Kenton, Del. 19955

[21] Appl. No.: 728,144

[22] Filed: Sept. 30, 1976

Related U.S. Application Data

[63] Continuation-in-part of Ser. No. 643,993, Dec. 31, 1975, abandoned.

[51] Int. Cl.[2] ..... F26B 3/06

[52] U.S. Cl. ..... 34/22; 34/29; 34/175; 34/210; 34/232; 98/8; 98/55

[58] Field of Search ..... 34/19, 22, 29, 169, 34/174–177, 210, 222, 232, 233, 236, 237, 225; 98/6, 8, 10, 52–57; 432/168, 169, 192, 500

[56] References Cited

U.S. PATENT DOCUMENTS

| | | | |
|---|---|---|---|
| 452,902 | 5/1891 | Coffee | 34/233 |
| 2,782,705 | 2/1957 | Breidert | 98/55 |
| 3,474,903 | 10/1969 | Ausherman | 34/174 |
| 3,600,823 | 8/1971 | Borron | 34/232 |
| 3,893,244 | 7/1975 | Danford | 34/22 |
| 3,935,648 | 2/1976 | Cox | 432/500 |

*Primary Examiner*—John J. Camby
*Assistant Examiner*—Henry C. Yuen
*Attorney, Agent, or Firm*—E. Leigh Hunt

[57] ABSTRACT

Disclosed is an apparatus and process for drying grains in situ immediately after harvesting without having to remove the moisture-containing grain from the truck or bin in which it was collected in the field during harvest. Perforated duct means are located longitudinally throughout the bin near the substantially air impervious floor of the bin, and this, in conjunction with perforated side panels within the bin, allows for heated air under pressure within the duct to be forced laterally outwardly through the grain and through the perforated side panels wherein the moisture-containing hot air is then allowed to exit upwardly through a flue space defined by the perforated side panels and the normal side panels of the bin or the like.

13 Claims, 6 Drawing Figures

PROCESS AND APPARATUS FOR DRYING GRAIN IN SITU

CROSS REFERENCES TO RELATED APPLICATIONS

This application is a continuation-in-part of my earlier filed U.S. patent application Ser. No. 643,993 filed Dec. 31, 1975, which is abandoned.

BACKGROUND OF THE INVENTION

This invention involves an apparatus and process for drying various grains in situ, primarily within truck or semi-trailer grain bodies. The process and apparatus of this invention avoid the expensive prior art methods utilized in drying grains which involve a high degree of labor and/or equipment or both to dry the grains. Conventional equipment involves unloading the grain and flowing it through a drying apparatus which necessarily is labor and time consuming. In addition, prior art conventional methods create substantial noise, dust, pollution, and the like. This invention is particularly useful in view of the recent government export regulations regarding reduced moisture content in exported grains.

The process and apparatus of this invention involve very little new equipment as conventional grain bodies can be modified for drying purposes during the grain harvesting season and then the grain body utilized for other purposes by removal of the added equipment which includes only the duct means and its supporting means and the perforated side panels.

This invention represents a major advance in the grain drying art by virtue of its simplicity of design, its labor saving benefits, and the overall inexpensive nature of the process and apparatus in order to carry out the invention as taught and claimed herein. Other prior art drying methods and equipment involve large plenum chambers beneath the floors along with perforated floors, various agitating means, and the like. In the process and apparatus of this invention, air is heated and placed under pressure exterior of the grain body, and it is conducted through duct means into the interior of the grain body. The grain body has perforated side panels to provide for the heated air to flow laterally outwardly from the perforated duct means to and through the perforated side panels and upwardly through the flue means defined by the space between the perforated side panels and the conventional side panels of the grain bin or grain body. It is important that the distance from the duct means to the grain surface is greater than the distance from the duct means to each perforated side panel. This provides for substantial lateral flow of the heated air between the duct means and the perforated side panels and for some vertical type flow of the hot air from the duct to the grain surface whereby the moisture laden air then exits upwardly from the flue space and away from the grain body.

SUMMARY OF THE INVENTION

The apparatus of this invention is defined as an apparatus for drying grains in situ in a grain bin having an upper grain surface when filled, comprising in combination:

a. a generally rectangular bin of a substantial length and width comprising;
   1. a normally horizontal floor;
   2. vertical side panels running lengthwise of the bin to define the length of the bin, said side panels having a large number of perforations substantially throughout its surface, with said perforations being smaller in size than the grain to be dried to allow air to pass and prevent grain from passing therethrough; and
   3. vertical end panels normally perpendicular to the side panels to define the ends of the bin;

b. perforated duct means adjacent the floor of said bin running longitudinally the length of the bin, said perforated duct means being spaced and located such that the horizontal distance from the perforations of the duct means to the nearest side panel is less than the vertical distance from the uppermost perforations of the duct means to the location of the upper grain surface, the perforations of said perforated duct means are of a size small enough to prevent the grain to be dried from entering said duct, said duct means further having hot air receiving means for receiving hot air under pressure from a source exterior of the bin into one end of the duct means and the other end of the duct means being in an airtight seal; and c. high-pressure power driven air fan means and associated air heater means arranged exteriorly of the bin and operatively associated with said hot air receiving means of the perforated duct means to force hot air under pressure into the perforated duct means, to provide lateral flow of hot dry air from the perforated duct means towards the perforated side panels whereby the hot air removes the moisture from the grain to be dried and the air and moisture pass both through the perforations of the side panels and through the top grain surface.

The apparatus of the invention in its preferred embodiment is as above defined except that conventional side panels extend lengthwise of the bin on the exterior of the bin to define the length of the bin, and the vertical perforated side panels in (a) (2) are disposed inwardly of said conventional vertical side panels and are spaced a small distance therefrom to define a flue space therebetween to provide a path for moisture laden air exiting through the perforations of the perforated side panels to exit upwardly and out of said flue and bin. This double walled embodiment offers added weather protection and heat efficiency.

It is preferred also that the perforated duct means is located equidistant from the perforated side panels.

It is most preferred that the perforated duct means of (b) is spaced vertically within the rectangular bin a distance from the floor such that the vertical distance from the uppermost perforations of the duct means to the upper grain surface is greater by about 20 to 50 percent of the distance between the outermost perforations of the duct and the nearest perforated side panels of (a) (2). In preferred embodiments the perforated duct means as well as the perforated side panels are removable whereby the grain bin or body can be utilized as a conventional grain body.

The process of the invention is defined as a process for drying moisture containing grain in situ in a grain bin having an upper grain surface, said bin having a floor, side panels defining the length of the bin with said side panels having perforations to allow air to pass there through without the passage of the grain to be dried, said bin further having end panels to define the width of the bin, said process comprising in combination:

a. heaating and pressurizing air exteriorly of the bin;

b. directing said heated air under pressure into the bin and along the longitudinal length of the bin near the floor at points nearer to the perforated side panels than the grain surface;

c. directing the heated air under pressure both laterally and outwardly from the interior of the bin towards the perforated side panels and also upwardly towards the grain surface throughout the grain and contacting the heated air with the moisture containing grain to pick up moisture from the grain; and then d. further directing said heated air containing moisture both to and through the perforated side panels and also upwardly and out through said grain surface by:

1. directing said heated air under pressure into perforated duct means extending along the longitudinal length of said grain bin with said duct being located near the floor of the bin at a distance such that the vertical height from the perforations of the duct means to the grain surface is greater than the distance from the perforated side panels to provide sufficient confinement of the heated air to force said heated air outwardly laterally to and through the side panels while at the same time a sufficient portion of the heated air moves upwardly throughout the grain and exits from the grain surface.

It is preferred that the moisture laden air exiting through the perforations of the side panels is then directed upwardly through a flue means that is defined by a second set of side panels arranged exteriorly of the perforated side panels to define flue means therebetween.

It is most preferred that the heated air under pressure is forced throughout the grain along a longitudinal length of the bin at a position such that the vertical height from the hot air entering the grain to the grain surface is 20 to 50 percent greater than the distance from the air entering the grain to the perforated side panels to provide sufficient lateral flow of the heated air to uniformly dry the grain throughout the grain bin.

DETAILED DESCRIPTION OF THE INVENTION

Figure 1:
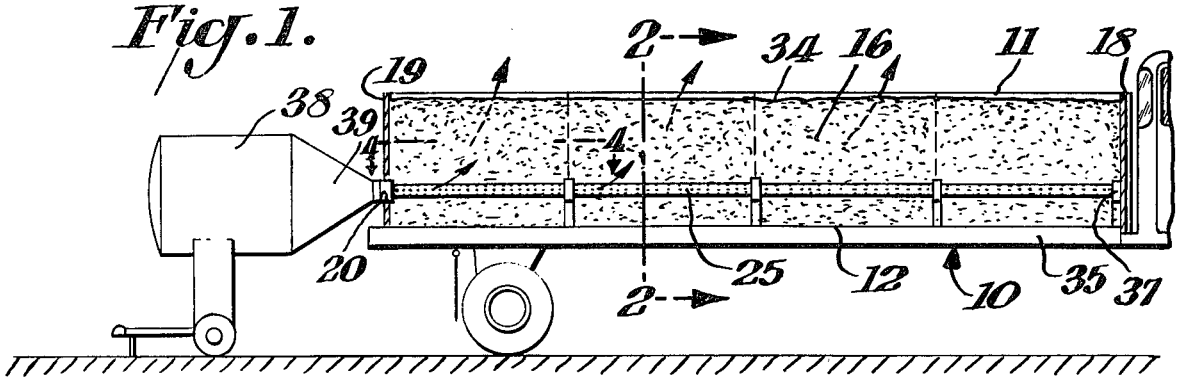
FIG. 1 is a perspective view of the apparatus of this invention showing the grain body in a longitudinal cross-sectional view.

With reference to the drawings, like numerals represent like parts throughout. in the drawings, the grain body or mobile bin 11 is mounted on a truck body 10, or it could likewise be a portion of any type of mobile equipment such as a wheeled farm wagon or a tractor trailer or the like. The bin 11 is generally rectangular in shape and has a horizontal substantially solid air impervious conventional floor 12, conventional solid side panels 13, held by vertical uprights or stakes 14, held in place by brackets and bolt means associated therewith 15, extending upwardly from the floor 12. The bin means or grain body 11 extends upwardly from frame 35.

The bin 11 has one conventional solid end panel 18 and one end panel 19 having a hole 20 for receiving perforated duct means 25. Mounted inboard of the conventional side panels 13 are perforated side panels 21 extending the entire length of the grain body on each side.

The perforated side panels have holes 22 that are of a size sufficient to allow air to exit but to prevent grain from exiting therethrough. The holes in the perforated side panels as well as the holes in the perforated duct means are generally within the range of about 3/32 inch to ⅛ inch, but they can be of a different size depending upon the particular grain to be dried.

The perforated side panels have a combination of reinforcing means 23 that also serve as spacers to define a flue 24 between the perforated side panels 21 and the conventional side panels 13.

Figure 3:
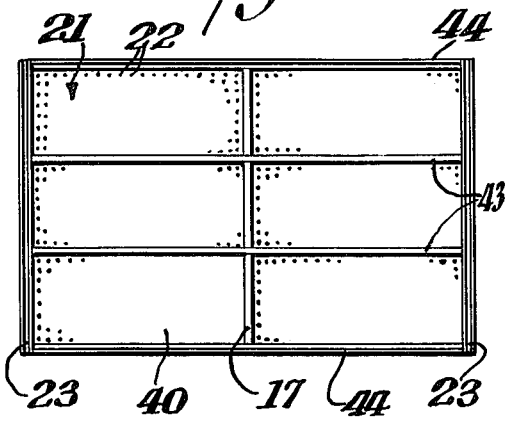
FIG. 3 is a view of a section of the perforated side panels and its associated reinforcing and support means.

In FIG. 3 is illustrated a particular perforated side panel that is bolted to the solid side panels. The perforated metal sheet 40 illustrated in FIG. 3 has vertical channel iron means 23 and center upright means 17. Typically, the vertical means 23 are 2-inch by 3-inch channel irons and the center horizontal reinforcing strips 43 are approximately ¼ inch by 1 inch. Top and bottom strips 44 preferably are 1 inch by 1 inch angle iron. All parts can be welded to the side panels as securing means.

The perforated duct means 25 is typically of 18 inches to 24 inches in diameter and runs the entire length of the grain body. The duct means 25 is typically most conveniently in short sections of about 4 feet in length. One end of each section would be reduced slightly in size to slide within and be overlapped by or mate with the opposite end of the adjacent duct means and then the overlapped sections secured in a fluid tight seal with the appropriate clamp means 29. Duct means 25 has holes 26 throughout its entire area sufficient to allow the heated air to pass from the interior of the duct means 36 laterally outwardly into the grain 16 to be dried.

Figure 6:
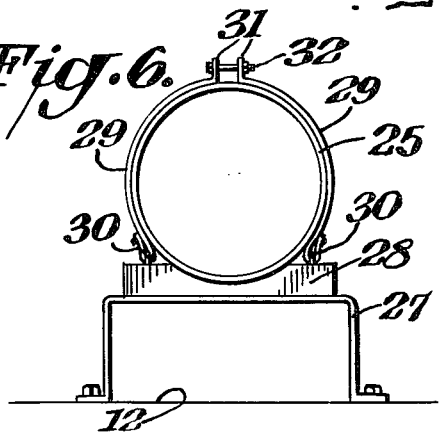
FIG. 6 is an end view of the perforated duct means and its associated securing means.

FIG. 6 shows an end view of the duct means and its clamping assembly. Bracket means 27 is adjacent to and attached to floor 12 by bolts or the like. Bracket means 27 has a base 28 to seat duct means 25 thereon. Ring clamp 29 is shown as two cooperating sections pivotally connected at 30 to base means 28. Each end of clamp means 29 is formed at 31 to accept bolt and nut assembly 32 for tightening the clamp 29 to secure adjacent sections of duct means 25 in a fluid tight secure arrangement.

Figure 2:
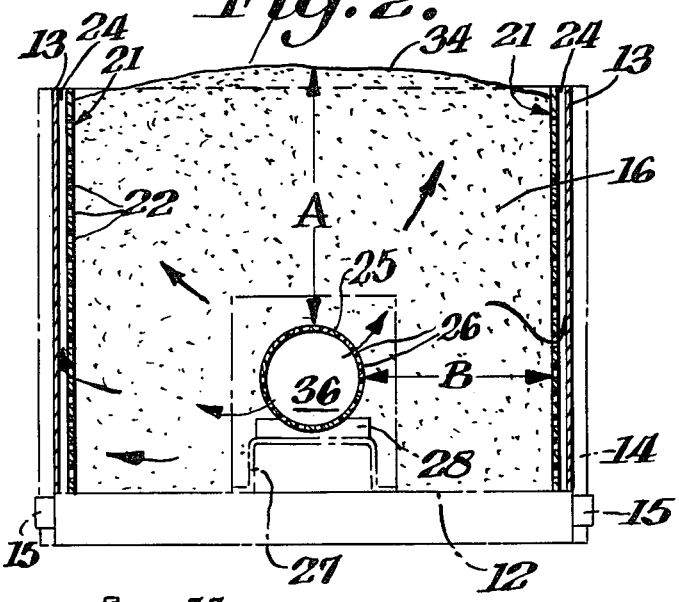
FIG. 2 is a cross-sectional view taken through lines 2—2 of FIG. 1.

Duct means 25 (shown in phantom in FIG. 2) is arranged within the grain body as in FIG. 2 such that the distance from the duct means to the grain surface 34, which distance is illustrated as A, is greater than the distance from duct means 25 to the perforated side panels 21, which distance is illustrated in FIG. 2 as B. Thus, in FIG. 2, distance A exceeds distance B. Such an arrangement assures that the heated air under pressure will flow substantially laterally outwardly from the duct means 25 towards and through the adjacent side panels 21 that are perforated.

The hot air inlet to duct means 25 is indicated as inlet 36 in FIGS. 1 and 2. The opposite end of the perforated duct means 25 is sealed at 37 as illustrated in FIG. 1.

High pressure power driven air and air heater means are illustrated as 38. The heated air under pressure is conducted from pressure and heater means 38 to air inlet means 36 via tapered duct 39 that is operatively connected to air inlet means 36 and duct means 25.

The holes in side panels 21 are typically spaced ⅛ inch apart for small grains and are of a size within about 3/32 inch to ⅛ inch to prevent the small grains from passing therethrough. The holes 26 in duct means 25 are typically spaced about ⅛ inch apart for small grains and are of a size of about 3/32 inch to ⅛ inch for small grains. For other grains of varying moisture contents, the appropriate hole size and spacing can be varied as well as the size of the duct means 25 and the particular capacity of the air heater and pressurizing unit 38.

Figure 4:
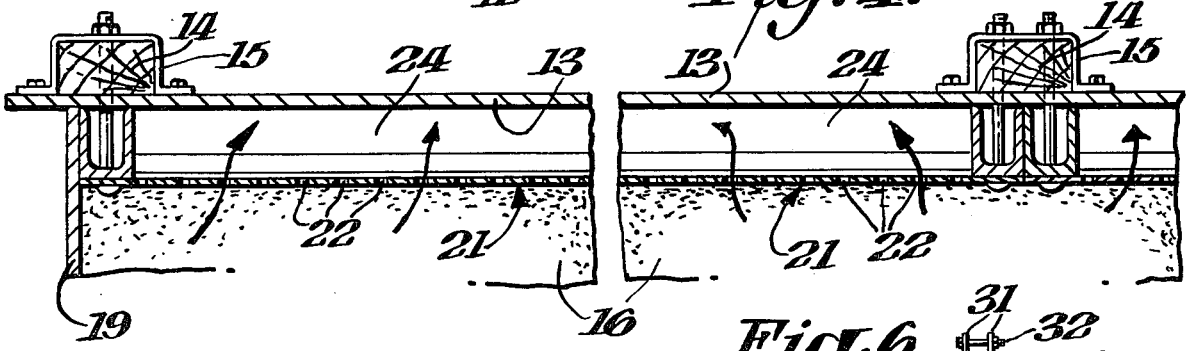
FIG. 4 is a sectional view taken through lines 4—4 of FIG. 1.
Figure 5:
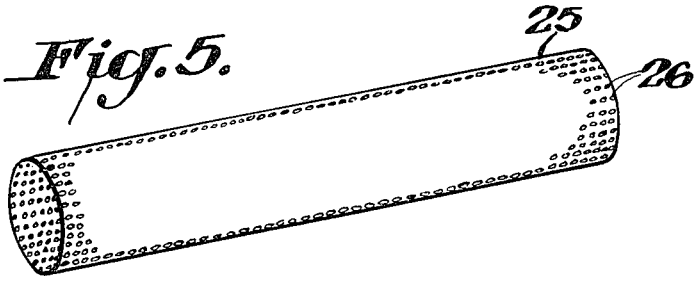
FIG. 5 is a perspective view of the perforated duct means.

Throughout the drawings, and in particular with reference to FIGS. 1, 2, and 4, the arrows indicate general directions of air flow throughout the grain 16.

EXAMPLE

Freshly harvested barley containing 16 percent water by weight is dried in situ immediately after harvesting. The apparatus is substantially as shown in the foregoing figures. The interior dimensions of the grain body are 32 feet in length, 4 feet deep, and approximately 84 inches in width with a 3-inch flue space between the perforated side panels and the conventional side panels. The holes in the perforated duct are 3/32 inch in diameter and 3/32 inch in diameter in the perforated side panels with a spacing of ⅛ inch between holes in each direction in the side panels and ⅛ inch between holes in the duct means. The perforated duct is 18 inches in diameter. The perforated side panels are made of 4-feet by 8-feet sections mounted on the inside of the conventional side panels of the conventional grain body.

The weather is clear, and the outside temperature is 85° F. The fan is operated at sufficient RPM to deliver approximately 15,000 cubic feet of air per minute at a temperature within the center of the duct means of 180° F. During operations, the temperature throughout the grain is within the range of about 140° to 145° F, and at the top of the flue, the temperature of the moisture laden air exiting therefrom is approximately 110° F. For the particular load of barley in question, the heater and fan operates for 1 hour and 40 minutes, and the fan is left running at the same rate for approximately 45 minutes without the heating means to cool the grain to approximately 87° F. The average moisture content of the barley grain after drying is reduced to about 12.15 percent from the original 16 percent. Distance A in FIG. 2 is about 30 percent greater than distance B.

For early harvested corn which may contain as high as 30 percent moisture or more, it is preferable to use 24-inch diameter duct means as approximately 15 percent by weight moisture is removed, and this provides sufficient hot air flow throughout the wet corn to dry it to acceptable limits and to provide favorable distribution of the hot air throughout the grain body.

For other specific grain drying problems, the skilled artisan can readily adapt the appropriate number and size of perforations in the side panels and duct means, as well as the duct means size and capacity of the air pressurizing and heating unit, to achieve the desired result without departing from the spirit and scope of applicant's invention as disclosed herein and claimed.

I claim:

1. Apparatus for drying grains in situ in a grain bin having an upper grain surface when filled, comprising in combination:

a. a generally rectangular bin of a substantial length and width comprising;
   1. a normally horizontal air impervious floor;
   2. vertical side panels running lengthwise of the bin to define the length of the bin, said side panels having a large number of perforations substantially throughout its surface, with said perforations being smaller in size than the grain to be dried to allow air to pass and prevent grain from passing therethrough; and
   3. vertical end panels normally perpendicular to the side panels to define the ends of the bin;

b. perforated duct means adjacent the floor of said bin running longitudinally the length of the bin, said perforated duct means being spaced and located such that the horizontal distance from the perforations of the duct means to the nearest side panel is less than the vertical distance from the uppermost perforations of the duct means to the location of the upper grain surface, the perforations of said perforated duct means are of a size small enough to prevent the grain to be dried from entering said duct, said duct means further having hot air receiving means for receiving hot air under pressure from a source exterior of the bin into one end of the duct means and the other end of the duct means being in an airtight seal; and c. high-pressure power driven air fan means and associated air heater means arranged exteriorly of the bin and operatively associated with said hot air receiving means of the perforated duct means to force hot air under pressure into the perforated duct means, to provide lateral flow of hot dry air from the perforated duct means towards the perforated side panels whereby the hot air removes the moisture from the grain to be dried and the air and moisture pass both through the perforations of the side panels and through the top grain surface.

2. The apparatus as in claim 1 wherein the bin comprises a portion of mobile grain transporting equipment.

3. The apparatus as in claim 1 wherein the perforated duct means of (b) is spaced vertically within the rectangular bin a distance from the floor such that the vertical distance from the uppermost perforations of the duct means to the upper grain surface is greater by about 20 to 50 percent of the distance between the outermost perforations of the duct and the nearest perforated side panels of (a) (2).

4. The apparatus as in claim 1 wherein the perforated duct means of (b) is removable to provide a conventional bin when said apparatus is not being utilized for grain drying.

5. The apparatus as in claim 1 having conventional side panels extending lengthwise of the bin on the exterior of the bin to define the length of the bin, and the vertical perforated side panels in (a) (2) are disposed inwardly of said conventional vertical side panels and are spaced a small distance therefrom to define a flue there between to provide a path for moisture laden air exiting through the perforations of the perforated side panels to exit upwardly and out of said flue and bin.

6. The apparatus as in claim 1 wherein the perforated duct means is located equidistant from the perforated side panels.

7. The apparatus as in claim 5 wherein the bin comprises a portion of mobile grain transporting equipment.

8. The apparatus as in claim 5 wherein the perforated duct means of (b) is spaced vertically within the rectangular bin a distance from the floor such that the vertical distance from the uppermost perforations of the duct means to the upper grain surface is greater by about 20 to 50 percent of the distance between the outermost perforations of the duct and the nearest perforated side panels of (a) (2).

9. The apparatus as in claim 5 wherein the perforated duct means of (b) is removable to provide a conventional bin when said apparatus is not being utilized for grain drying.

10. The apparatus as in claim 5 wherein the perforated duct means is located equidistant from the perforated side panels.

11. A process for drying moisture containing grain in situ in a grain bin having an upper grain surface, said bin having an air impervious floor, side panels defining the length of the bin with said side panels having perforations to allow air to pass there through without the passage of the grain to be dried, perforated duct means to convey heated air into said grain bin, said bin further having end panel to define the width of the bin, said process comprising in combination:

a. heating and pressurizing air exteriorly of the bin;

b. directing said heated air under pressure into the bin and along the longitudinal length of the bin near the floor at points nearer to the perforated side panels than the grain surface;

c. directing the heated air under pressure both laterally and outwardly from the interior of the bin towards the perforated side panels and also upwardly towards the grain surface throughout the grain and contacting the heated air with the moisture containing grain to pick up moisture from the grain; and then d. further directing said heated air containing moisture both to and through the perforated side panels and also upwardly and out through said grain surface by:

1. directing said heated air under pressure into said perforated duct means extending along the longitudinal length of said grain bin with said duct being located near the floor of the bin at a distance such that the vertical height from the perforations of the duct means to the grain surface is greater than the distance from the perforated side panels to provide sufficient confinement of the heated air to force said heated air outwardly laterally to and through the side panels while at the same time a sufficient portion of the heated air moves upwardly throughout the grain and exits from the grain surface.

12. The process as in claim 11 wherein moisture laden air exiting through the perforations of the side panels is then directed upwardly through a flue means that is defined by a second set of side panels arranged exteriorly of the perforted side panels to define flue means there between.

13. The process as in claim 11 wherein the heated air under pressure is forced throughout the grain along a longitudinal length of the bin at a position such that the vertical height from the hot air entering the grain to the grain surface is 20 to 50 percent greater than the distance from the air entering the grain to the perforated side panels to provide sufficient lateral flow of the heated air to uniformly dry the grain throughout the grain bin.

* * * * *